US006024481A

United States Patent [19]

Hillström et al.

[11] Patent Number: 6,024,481

[45] Date of Patent: Feb. 15, 2000

[54] MIXER FOR MIXING OF LIQUIDS OR SUSPENSIONS AND METHOD FOR MIXING

[75] Inventors: Anders Hillström, Tullinge; Peter Sjöberg, Solna, both of Sweden

[73] Assignee: Alfa Laval AB, Lund, Sweden

[21] Appl. No.: 08/817,533

[22] PCT Filed: Oct. 23, 1995

[86] PCT No.: PCT/SE95/01252

§ 371 Date: Jul. 9, 1997

§ 102(e) Date: Jul. 9, 1997

[87] PCT Pub. No.: WO96/12555

PCT Pub. Date: May 2, 1996

[30] Foreign Application Priority Data

Oct. 25, 1994 [SE] Sweden ..... 9403660

[51] Int. Cl.[7] ..... B01F 7/16

[52] U.S. Cl. ..... 366/155.1; 366/290; 366/245

[58] Field of Search ..... 366/290, 293, 366/307, 303, 302, 325.1, 329.1, 329.2, 329.3, 330.1, 336, 263, 270, 317, 245, 155.1, 154.1

[56] References Cited

U.S. PATENT DOCUMENTS

| | | | |
|---|---|---|---|
| 531,718 | 1/1895 | Detwiler | 366/307 |
| 776,383 | 11/1904 | Bryan | 366/329.1 |
| 2,438,204 | 3/1948 | Castner | 366/293 |
| 3,179,380 | 4/1965 | Drayer | 366/329.1 |
| 3,194,638 | 7/1965 | Neuville | 366/290 |
| 4,021,021 | 5/1977 | Hall et al. | 366/302 |
| 4,483,624 | 11/1984 | Bacon, Jr. et al. | 366/293 |
| 4,610,547 | 9/1986 | Bennett et al. | 366/293 |
| 4,799,862 | 1/1989 | Davidson et al. | 366/307 |
| 5,141,392 | 8/1992 | Uvemo | 366/263 |
| 5,211,924 | 5/1993 | Lee et al. | 366/329.1 |
| 5,399,014 | 3/1995 | Takata et al. | 366/293 |
| 5,511,881 | 4/1996 | Post et al. | 366/263 |

FOREIGN PATENT DOCUMENTS

| | | |
|---|---|---|
| 0 011 559 | 5/1980 | European Pat. Off. . |
| 0 394 006 | 10/1990 | European Pat. Off. . |
| 2 420 635 | 12/1974 | Germany . |
| 9100942 | 10/1992 | Sweden . |

*Primary Examiner*—Tony G. Soohoo
*Attorney, Agent, or Firm*—Fish & Richardson P.C.

[57] ABSTRACT

A mixer for liquid or suspensions comprises two mixing chambers each of which is provided with an outer inlet. The chambers are connected to each other in such a way that the first chamber leads to the second chamber. A number of mixing elements are arranged on a rotating axis which is common for the two chambers. The mixing elements have different shapes in the two chambers. In the first chamber the mixing elements are arranged to achieve mixing by means of large shear forces. In the second chamber the mixing elements are arranged to achieve mixing by stirring mainly without shear forces. A method for continuous mixing comprises mixing a little amount of a first liquid with a considerably larger amount of a second liquid in a first mixing chamber in which the mixing takes place by way of high shear forces. The obtained mixture is subjected to mixing by stirring mainly without shear forces in a second mixing chamber.

11 Claims, 2 Drawing Sheets

MIXER FOR MIXING OF LIQUIDS OR SUSPENSIONS AND METHOD FOR MIXING

FIELD OF THE INVENTION

The present invention relates to a mixer for mixing of liquids or suspensions and a method for mixing.

BACKGROUND OF THE INVENTION

On the market there are since long different mixers consisting of an agitator which is driven by a motor in a cylindrical vessel. The means which achieve the stirring may be one or several plane shovels or plates, a propeller or a turbine wheel. Such mixers have been used in many connections and for many different purposes.

SUMMARY OF THE INVENTION

According to the invention there is now proposed an effective and space saving embodiment of a mixer. The mixer according to the invention is mainly characterized in that it comprises two mixing chambers provided each with an exterior inlet, a first chamber having a little volume in relation to a second chamber. The chambers are connected to each other in such a way that the outlet of the first chamber is an inlet to the second chamber. A number of mixing elements are arranged on a rotating axis which is common for the two chambers. The mixing elements have different shape in the two chambers and the mixing elements in the first chamber are arranged to achieve mixing by means of large shear forces, while the mixing elements in the second chamber are arranged to achieve mixing through stirring mainly without shear forces.

With a mixer of such design there is obtained two different kinds of mixing with only one driving means.

The high shear forces which are needed for the mixing in the first chamber demand a high addition of energy.

With advantage the first chamber is arranged above the second chamber, since the bearing of the rotating axis in the larger lower chamber gives a smaller influence on the flow conditions in the same. If so is desired the first smaller chamber may, however, be arranged below the second chamber. Providing the mixer with a vertical stirring axis means that the demand of space is little.

In order to achieve the desired high shear forces in the first chamber the mixing elements in the same suitably consists of turbine wheels with shovels. Depending on the capacity of the mixer may 4, 6 or more shovels be used. Also other kinds of mixing elements which give rise to high shear forces may of course be used.

The mixing elements in the second chamber consist with advantage of impeller formed agitators which give a little increase in pressure.

With advantage as well the upper as the lower chamber are provided with flow disturbing baffle plates at the walls of the mixing chamber. These plates are preferably arranged radially in the respective chamber with an extension of ~1/10 of the diameter of the mixing chamber.

Both the upper and the lower mixing chamber are suitably also provided with annular horizontal plates arranged between the mixing elements. These plates divide the mixing chambers in a number of partial spaces where separate vortex formations occur.

The mixer according to the invention is with advantage provided with a motor with variable rotation speed which drives the rotating axis. By way of such an arrangement the mixer may easily be adapted to different kinds of mixing tasks.

The invention also comprises a method for continuous mixing of a small amount of a first liquid with a considerably larger amount of a second liquid in a mixer of the kind which has been described above. The first liquid is mixed with the second liquid in a first mixing chamber in which the mixing takes place by means of high shear forces, after which the obtained mixture in a second mixture chamber is subjected to mixing by stirring mainly without shear forces.

The method according to the invention is suitable for degumming, refining or other treatment of vegetable oils. In such a treatment the first liquid is a chemical additive as for example an accid, a caustic solution or anti-oxidant while the second liquid consists of vegetable oil.

The method is suitably carried through in such a way that a chemical additive is mixed with a partial flow of vegetable oil in the first mixing chamber while the remaining amount of vegetable oil is added in the second chamber.

With advantage the degumming of oil may be carried through such that the desired amount of acid is mixed with the whole flow of vegetable oil in the first mixing chamber while the caustic solution which shall neutralize acid and fatty acids is added into the obtained mixture in the second mixing chamber.

BRIEF DESCRIPTION OF THE DRAWINGS

The mixer according to the invention is described further with reference to the attached drawings, FIG. 1 of which shows one as an example chosen embodiment of a mixer while

DETAILED DESCRIPTION

Figure 1:
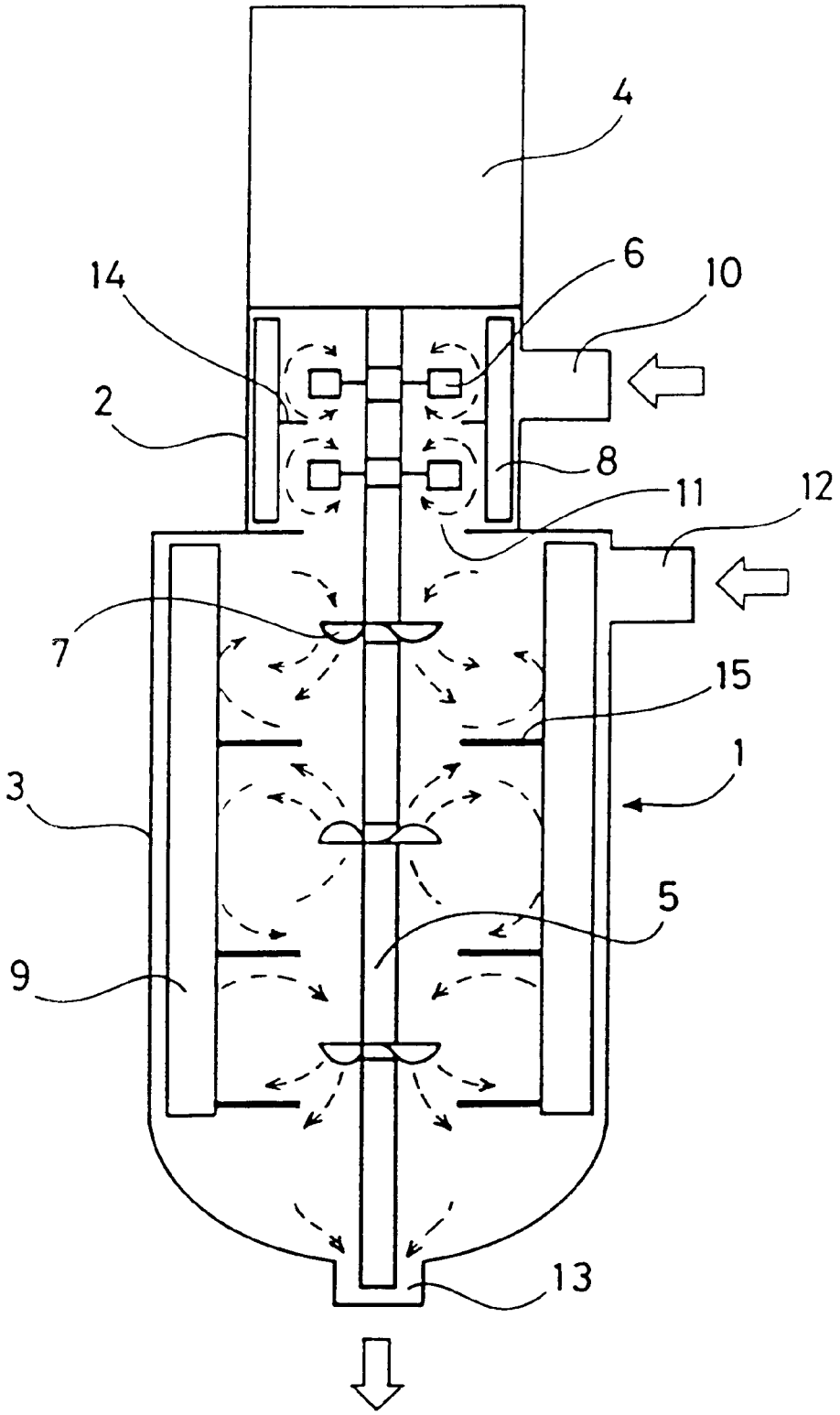

In FIG. 1 there is shown a mixer 1 comprising two cylindrical mixing chambers 2, 3. Above these chambers there is a motor 4. Connected to and driven by the motor there is a vertical axis 5 which in a manner which is not shown is mounted in bearings at the bottom of the chamber 3. On the common axis 5 there are mixing elements 6 and 7. In the upper mixing chamber 2 the mixing elements 6 consist of turbine wheels with showels. In the embodiment of the mixer that is shown there are two mixing elements in the upper chamber and three in the lower. Depending on the desired capacity of the mixer of course the number of mixing elements may vary. The mixing elements 7 in the lower mixing chamber have propeller shape and have as is seen on the drawing been arranged to give upwards and downwards flow in the mixing chamber alternatively. Along the walls of the mixing chambers there are radially arranged buffle plates 8, 9. The plates which extend radially inwards are arranged with a certain opening gap from the wall of the chamber. Their length is the same as the height of the mixing chamber. The with is usually ~1/10 of the diameter of the mixing chamber. The mixing chamber 2 has an inlet 10 and an outlet 11 which constitutes the inlet into the mixing chamber 3. This has a further inlet 12. In the bottom of the mixing chamber 3 there is an outlet 13. In both mixing chambers there are annular horizontal plates 14, 15 which divide the mixing chambers in a number of partial spaces. These partial spaces make the presence of separate vortex formations possible which facilitate the mixing.

With the shown embodiment of the mixer completely different flow conditions may be obtained in the two mixing chambers despite the fact that the common axis is rotating with a certain rotation speed. The energy which is added to the upper mixing chamber and gives rise to the high shear forces may be around 20 times larger than the addition of energy in the lower mixing chamber.

The diameter of the turbine wheel may be 140–190 mm with a diameter of 300 mm in the upper mixing chamber. The diameter of the propeller may be 160–250 mm at a diameter of 500 mm in the lower treatment chamber.

Figure 2:
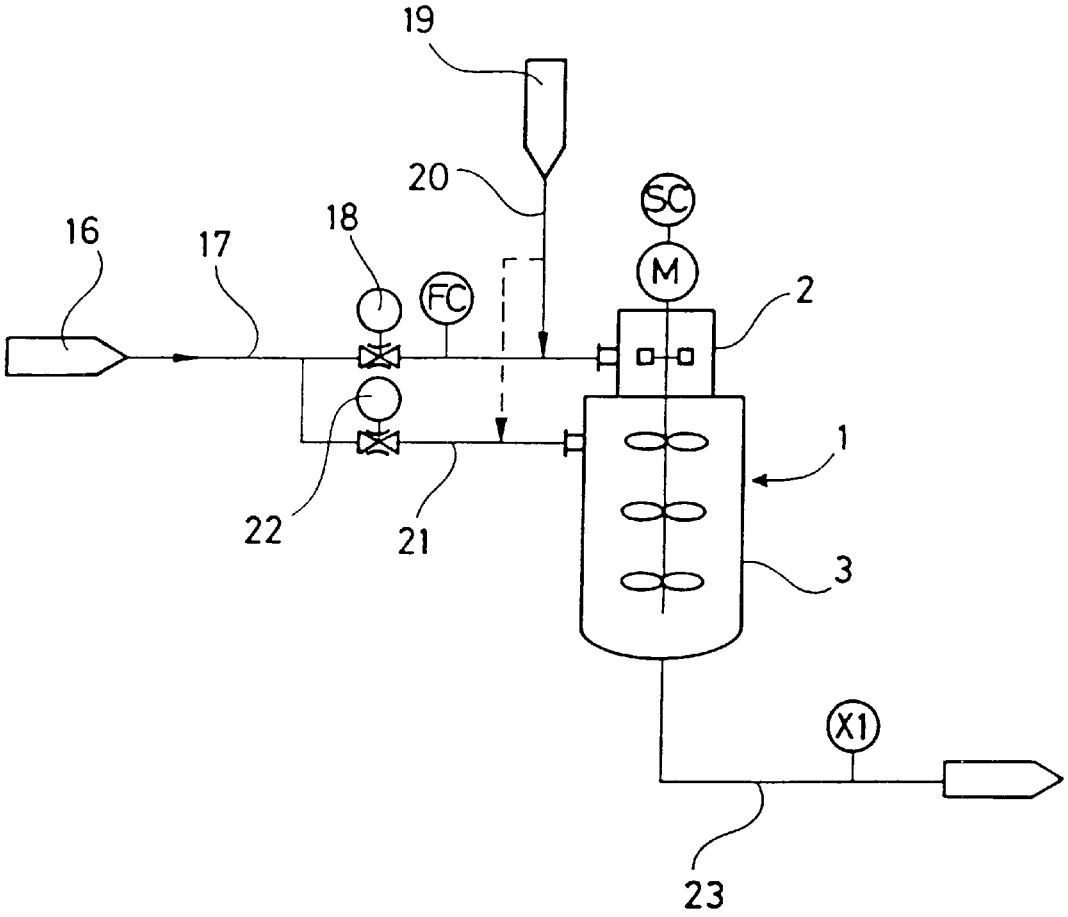
FIG. 2 shows an arrangement in which the mixer is a part.

In FIG. 2 there is shown how the mixer according to the invention may be used for a mixing task in connection with treatment of vegetable oil.

Vegetable oil is led to the mixer 1 from a source 16 by way of a conduit 17 in which there is a flow controlling valve 18. The conduit 17 leads to the upper mixing chamber 2. A chemical additive is added to the conduit 17 from a source 19 by way of a conduit 20. The mixture of vegetable oil and chemical additive which enters the treatment chamber 2 is subjected to such high shear forces that the additive very rapidly is divided into and reacts with the vegetable oil. From the treatment chamber 2 the obtained mixture passes down to the lower mixing chamber 3. To this a further amount of vegetable oil is added through the conduit 21. Also in this conduit there is a flow controlling valve 22. In the lower treatment chamber 3 the added vegetable oil is mixed with the mixture from the mixing chamber 3 by stirring. After mixing the oil is led further for further treatment through a conduit 23.

As is seen in the drawing chemical addition may take place also to the treatment chamber 3 if it should be desirable.

If the treatment that shall be carried through of the vegetable oil consists of a degumming the additive consists of some acid as citric acid, phosphoric acid or sulphuric acid which are added in an amount of 0.05–0.20% of the vegetable oil. The addition of acid is accompanied by an addition of caustic solution in an mount of 0.1–15% of the flow of vegetable oil. This addition may take place either in a further mixer or at relatively low flows in that the acid is added to the upper mixing chamber and caustic solution to the lower mixing chamber in the same mixer.

The method according to the invention may also be used at other additions to the vegetable oil as an addition of anti-oxidant (end treatment) or in connection with hardening of the oil when a catalyzer is added in the form of a suspension.

When treating according to the invention the chemical additive may be used efficiently which may lead to a lower use of chemicals which brings about lower costs for the producer. With the effective mixing the holding time in the mixer may be short—below 30 seconds.

We claim:

1. A mixer for mixing of liquids or suspensions comprising two mixing chambers, each of said mixing chambers having an exterior inlet, a first one of said two chambers being smaller in volume in relation to a second one of said two chambers, said chambers being in fluid communication with one another, and a plurality of mixing elements arranged on an axis of rotation which axis is common for the two chambers, said mixing elements in said first chamber being shaped differently from said mixing elements in said second chamber, said mixing elements in said first chamber comprising means for mixing by application of large shear forces, and said mixing elements in said second chamber comprising means for mixing by stirring in the substantial absence of large shear forces.

2. The mixer of claim 1 wherein, in use, the first chamber is arranged above the second chamber.

3. The mixer of claim 1 wherein the mixing elements in the first chamber comprise a turbine wheel with shovels.

4. The mixer of claim 1 wherein the mixing elements in the second chamber comprise propeller formed agitators.

5. The mixer of claim 1 wherein both of the chambers further comprise flow disturbing baffle plates along the walls of the chambers.

6. The mixer of claim 1 wherein both of the chambers further comprise annular horizontal plates arranged between the mixing elements thus partially subdividing each chamber.

7. The mixer of claim 1 wherein the rotatable axis is driven by a motor having a variable rotation speed.

8. A method for the continuous mixing of liquids or suspensions, the method comprising mixing a small amount of a first liquid with a relatively larger amount of a second liquid in a first one of two mixing chambers to form a mixture, said mixing occurring by applying large shear forces to said mixture, moving said mixture into a second one of said two mixing chambers and mixing in said second mixing chamber by stirring in the substantial absence of large shear forces.

9. A method for the processing of a vegetable oil, the method comprising mixing a small amount of a first liquid with a relatively larger amount of a vegetable oil in a first one of two mixing chambers to form a mixture, said mixing occurring by applying large shear forces to said mixture, moving said mixture into a second one of said two mixing chambers and mixing in said second mixing chamber by stirring in the substantial absence of large shear forces.

10. The method of claim 9 wherein the first liquid is a chemical additive, and further wherein additional vegetable oil is added directly to the second chamber.

11. The method of claim 9 wherein the first liquid is an acid, and further wherein a caustic solution is added directly to the second chamber.

* * * * *